US009875681B2

(12) United States Patent
Lee et al.

(10) Patent No.: US 9,875,681 B2
(45) **Date of Patent: *Jan. 23, 2018**

(54) METHOD OF DRIVING DISPLAY PANEL AND DISPLAY APPARATUS FOR PERFORMING THE SAME

(71) Applicant: SAMSUNG DISPLAY CO., LTD., Yongin-si, Gyeonggi-do (KR)

(72) Inventors: Kyoung-Won Lee, Seoul (KR); Su-Hyeong Park, Gyeongju-si (KR); Bong-Hyun You, Yongin-si (KR); Ho-Yong Jung, Seongnam-si (KR); Eun-Ho Lee, Suwon-si (KR); Hyun-Dae Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/414,398

(22) Filed: Jan. 24, 2017

(65) Prior Publication Data

US 2017/0132964 A1 May 11, 2017

Related U.S. Application Data

(63) Continuation of application No. 14/495,830, filed on Sep. 24, 2014, now Pat. No. 9,583,036.

(30) Foreign Application Priority Data

Feb. 11, 2014 (KR) ..... 10-2014-0015681

(51) Int. Cl.
*G09G 3/20* (2006.01)

(52) U.S. Cl.
CPC ..... *G09G 3/2029* (2013.01); *G09G 2310/027* (2013.01); *G09G 2310/08* (2013.01);
(Continued)

(58) Field of Classification Search
CPC ..... G09G 2310/027; G09G 2320/0247; G09G 2320/0613; G09G 2320/103; G09G 2330/021; G09G 3/2029
See application file for complete search history.

(56) References Cited

U.S. PATENT DOCUMENTS 7,289,161 B2 10/2007 Yamakawa et al.
8,111,270 B2 2/2012 Kim et al.
(Continued)

FOREIGN PATENT DOCUMENTS

KR 10-2004-0078298 A 9/2004
KR 10-2007-0070926 A 7/2007
(Continued)

OTHER PUBLICATIONS

Korean Patent Abstract for KR 10-2008-0000346 A, which corresponds to KR Publ. No. 10-1214658 B1, published Jan. 2, 2008, 1 page.

(Continued)

*Primary Examiner* — Afroza Chowdhury
(74) *Attorney, Agent, or Firm* — Lewis Roca Rothgerber Christie LLP

(57) ABSTRACT

A method of driving a display panel includes dividing an input image into a plurality of segments; generating flicker levels of respective ones of the segments; determining a frame rate of the display panel based on the flicker levels of the segments; and outputting a data voltage to the display panel at the frame rate.

7 Claims, 7 Drawing Sheets

(52) U.S. Cl.
CPC ..... *G09G 2320/0247* (2013.01); *G09G 2320/103* (2013.01); *G09G 2330/021* (2013.01); *G09G 2340/0435* (2013.01); *G09G 2360/16* (2013.01)

(56) References Cited

U.S. PATENT DOCUMENTS

| | | | | |
|---|---|---|---|---|
| 8,144,255 | B2 * | 3/2012 | Hirayama | G06K 9/3266 348/468 |
| 8,487,848 | B2 * | 7/2013 | Lin | G09G 3/3611 345/87 |
| 8,743,240 | B2 | 6/2014 | Horiuchi | |
| 2007/0273787 | A1 | 11/2007 | Ogino et al. | |
| 2008/0136845 | A1 | 6/2008 | Nakanishi | |
| 2009/0251445 | A1 | 10/2009 | Ito et al. | |
| 2010/0085386 | A1 | 4/2010 | Lin et al. | |
| 2010/0156886 | A1 | 6/2010 | Kawabe | |
| 2010/0302214 | A1 | 12/2010 | Kim et al. | |
| 2011/0084971 | A1 | 4/2011 | Kuo et al. | |

FOREIGN PATENT DOCUMENTS

| | | | |
|---|---|---|---|
| KR | 10-1214658 | B1 | 12/2012 |
| KR | 10-2013-0005807 | A | 1/2013 |
| KR | 10-2015-0082774 | | 7/2015 |

OTHER PUBLICATIONS

EPO Search Report dated Aug. 21, 2015, for corresponding European Patent Application 15151749.7, (15 pages).

* cited by examiner

| | | | | | | | |
|---|---|---|---|---|---|---|---|
| S11 | S12 | S13 | S14 | S15 | S16 | S17 | S18 |
| S21 | S22 | S23 | S24 | S25 | S26 | S27 | S28 |
| S31 | S32 | S33 | S34 | S35 | S36 | S37 | S38 |
| S41 | S42 | S43 | S44 | S45 | S46 | S47 | S48 |
| S51 | S52 | S53 | S54 | S55 | S56 | S57 | S58 |

METHOD OF DRIVING DISPLAY PANEL AND DISPLAY APPARATUS FOR PERFORMING THE SAME

CROSS-REFERENCE TO RELATED APPLICATION

This application is a continuation of U.S. patent application Ser. No. 14/495,830, filed on Sep. 24, 2014, which claims priority to and the benefit of Korean Patent Application No. 10-2014-0015681, filed on Feb. 11, 2014 in the Korean Intellectual Property Office KIPO, the entire content of both of which are herein incorporated by reference in their entirety.

BACKGROUND

1. Field

Aspects of example embodiments of the present inventive concept relate to a method of driving a display panel and a display apparatus for performing the method.

2. Description of the Related Art

A method to reduce (e.g., minimize) power consumption of an information technology (IT) product such as a table PC and a note PC have been studied.

To reduce (e.g., minimize) the size of the IT product which includes a display panel, power consumption of the display panel may be reduced (e.g., minimized). When the display panel displays a static image, the display panel may be driven in a relatively low frequency so that power consumption of the display panel may be reduced.

When the display panel is driven in the relatively low frequency, a flicker may be generated so that display quality may decrease.

SUMMARY

Aspects of example embodiments of the present inventive concept are directed to a method of driving a display panel capable of reducing power consumption and increasing (e.g., improving) display quality.

Aspects of example embodiments of the present inventive concept are also directed to a display apparatus for performing the above-mentioned method.

Aspects of example embodiments of the present inventive concept are directed to a method of driving a display panel for reducing power consumption and increasing (e.g., improving) display quality, and a display apparatus for performing the method.

In one example embodiment of the present invention, there is provided a method of driving a display panel, the method including: dividing an input image into a plurality of segments; generating flicker levels of respective ones of the segments; determining a frame rate of the display panel based on the flicker levels of the segments; and outputting a data voltage to the display panel at the frame rate.

In one embodiment, the method further includes determining whether the input image is a static image or a video image, wherein when the input image is the static image, the frame rate of the display panel is determined based on the flicker levels of the segments.

In one embodiment, the generating the flicker levels of the segments includes converting luminance of a plurality of pixels at each of the segments into flicker levels of respective ones of the pixels; and calculating the flicker levels of the pixels in the segments.

In one embodiment, the input image includes a red grayscale, a green grayscale and a blue grayscale, and the generating the flicker levels of the segments further includes extracting the luminance of the plurality of pixels at each of the segments based on the red grayscale, the green grayscale and the blue grayscale.

In one embodiment, the calculating the flicker levels of the pixels in the segments includes adding up the flicker levels of the respective ones of the pixels.

In one embodiment, the calculating the flicker levels of the pixels in the segments includes: setting weights of the respective ones of the pixels according to positions of the respective ones of the pixels; and calculating a weighted sum of flicker levels of the pixels.

In one embodiment, ones of the pixels at an outside portion of the display panel have a relatively large weight.

In one embodiment, the segments have a rectangular shape having a longer side extending in a horizontal direction.

In one embodiment, the determining the frame rate of the display panel based on the flicker levels of the segments includes comparing a maximum flicker level of the segments to a threshold.

In one embodiment, the determining the frame rate of the display panel based on the flicker levels of the segments includes comparing an average of flicker levels of segments having relatively high flicker levels to a threshold.

In one embodiment, a first input image includes a first grayscale representing black and a second grayscale representing gray, the first input image having a first ratio between the first grayscale and the second grayscale, the second grayscale being concentrated at a central portion of the display panel in the first input image, a second input image includes the first grayscale and the second grayscale, the second input image having the first ratio between the first grayscale and the second grayscale, the second grayscale being distributed throughout the display panel in the second input image, and a first frame rate for the first input image is different form a second frame rate for the second input image.

In one embodiment, the first frame rate is greater than the second frame rate.

According to another embodiment of the present invention, a display apparatus including: a display panel configured to display an image; a low frequency driving part configured to divide an input image into a plurality of segments, to generate flicker levels of respective ones of the segments and to determine a frame rate of the display panel based on the flicker levels of the segments; and a data driver configured to output a data voltage to the display panel at the frame rate.

In one embodiment, the low frequency driving part includes a static image determining part configured to determine whether the input image is a static image or a video image, and when the input image is the static image, the low frequency driving part determines the frame rate of the display panel based on the flicker levels of the segments.

In one embodiment, the low frequency driving part is configured to convert luminance of a plurality of pixels at each of the segments into flicker levels of respective ones of the pixels, and to calculate the flicker levels of the pixels in the segments to generate the flicker levels of the segments.

In one embodiment, the input image includes a red grayscale, a green grayscale and a blue grayscale, and the low frequency driving part is configured to extract the luminance of the plurality of pixels at each of the segments based on the red grayscale, the green grayscale and the blue grayscale.

In one embodiment, the low frequency driving part is configured to add up the flicker levels of the respective ones of the pixels to generate the flicker levels of the segments.

In one embodiment, the low frequency driving part is configured to set weights of the respective ones of the pixels according to positions of the respective ones of the pixels, and to calculate a weighted sum of flicker levels of the pixels to generate the flicker levels of the segments.

In one embodiment, a first input image includes a first grayscale representing black and a second grayscale representing gray, the first input image having a first ratio between the first grayscale and the second grayscale, the second grayscale being concentrated at a central portion of the display panel in the first input image, a second input image includes the first grayscale and the second grayscale, the second input image having the first ratio between the first grayscale and the second grayscale, the second grayscale being distributed throughout the display panel in the second input image, and a first frame rate for the first input image is different form a second frame rate for the second input image.

In one embodiment, the first frame rate is greater than the second frame rate.

According to the method of driving the display panel and the display apparatus for performing the method according to example embodiments of the present invention, the frame rate is adjusted according to an image displayed on the display panel so that power consumption of the display apparatus may be reduced. In addition, the frame rate is determined using (or utilizing) the flicker level of the segments of the image on the display panel so that display quality of the display panel may be increased (e.g., improved).

BRIEF DESCRIPTION OF THE DRAWINGS

The above and other features and aspects of embodiments of the present inventive concept will become more apparent by describing in detail example embodiments thereof with reference to the accompanying drawings, in which.

DETAILED DESCRIPTION

Hereinafter, embodiments of the present inventive concept will be explained in more detail with reference to the accompanying drawings.

Figure 1:
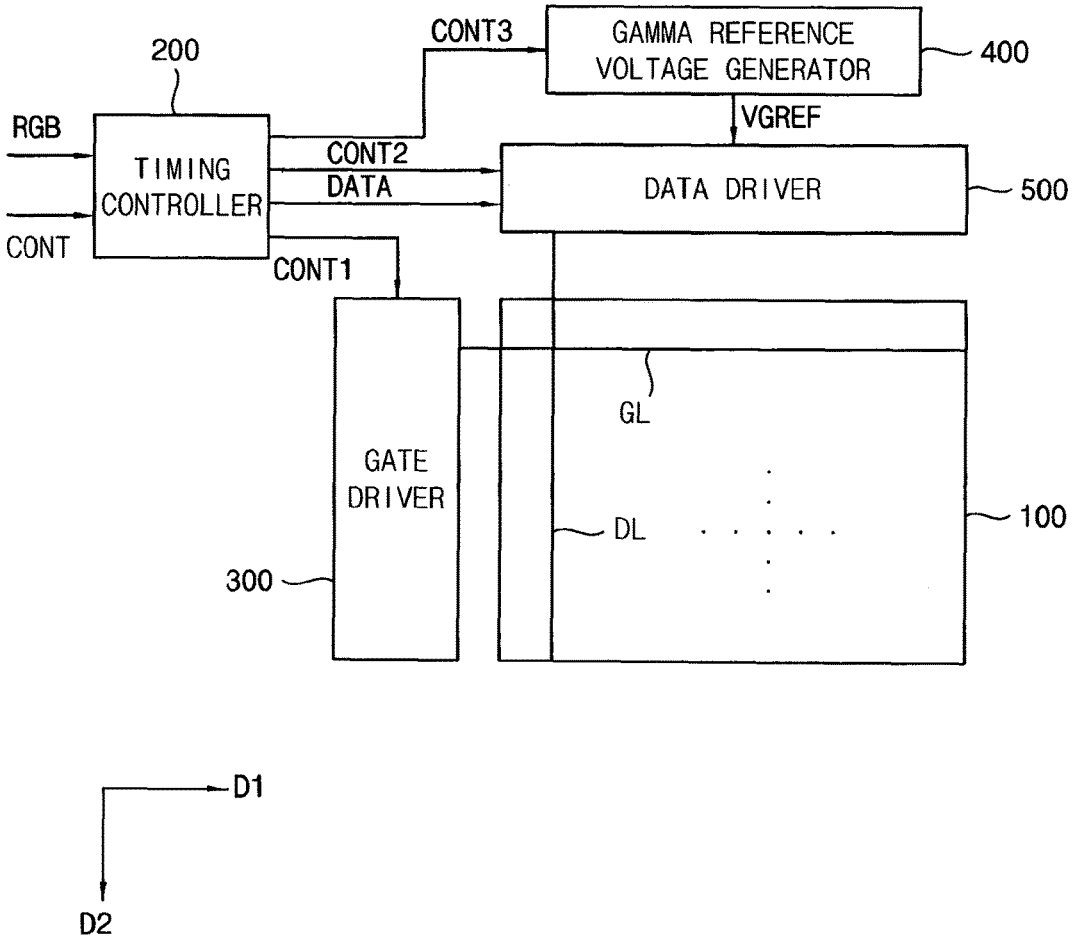
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 has a display region at (e.g., on) which an image is displayed and a peripheral region adjacent to the display region.

The display panel 100 includes a plurality of gate lines GL, a plurality of data lines DL and a plurality of unit pixels coupled (e.g., connected) to the gate lines GL and the data lines DL (e.g., at crossings of the gate lines GL and the data lines DL). The gate lines GL extend in a first direction D1 and the data lines DL extend in a second direction D2 crossing the first direction D1.

Each unit pixel includes a switching element, a liquid crystal capacitor and a storage capacitor. The liquid crystal capacitor and the storage capacitor are electrically coupled (e.g., connected) to the switching element. The unit pixels may be in (e.g., disposed in) a matrix form.

The timing controller 200 receives input image data RGB and an input control signal CONT from an external apparatus. The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

For example, the timing controller 200 may adjust a frame rate of the display panel 100 based on the input image data RGB.

The timing controller 200 generates the third control signal CONT3 for controlling an operation of the gamma reference voltage generator 400 based on the input control signal CONT, and outputs the third control signal CONT3 to the gamma reference voltage generator 400.

A structure and an operation of the timing controller 200 are explained referring to FIGS. 2 to 6 in more detail.

The gate driver 300 generates gate signals for driving the gate lines GL in response to the first control signal CONT1 received from the timing controller 200. The gate driver 300 sequentially outputs the gate signals to the gate lines GL.

The gate driver 300 may be directly mounted on the display panel 100, or may be coupled (e.g., connected) to the display panel 100 via a tape carrier package (TCP). Alternatively, the gate driver 300 may be integrated into the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be in (e.g., disposed in) the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages in an analog form (type) using the gamma reference voltages VGREF. The data driver 500 outputs the data voltages to the data lines DL.

The data driver 500 may be directly mounted on the display panel 100, or may be coupled (e.g., connected) to the display panel 100 via a TCP. Alternatively, the data driver 500 may be integrated into the display panel 100.

Figure 2:
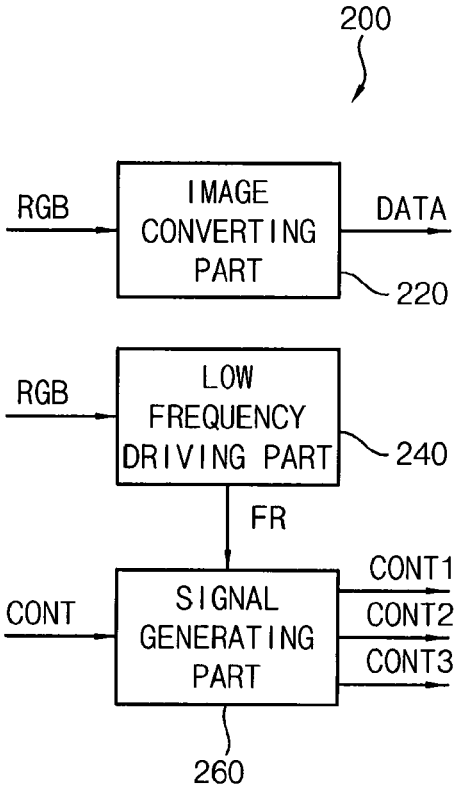
FIG. 2 is a block diagram illustrating a timing controller shown in FIG. 1.
Figure 3:
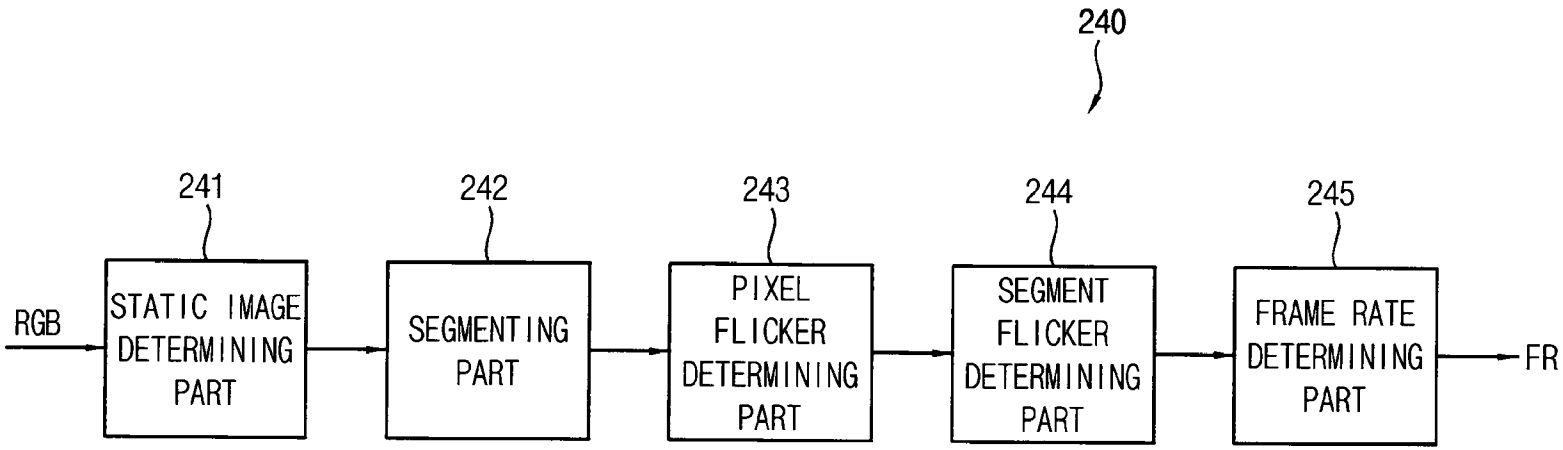
FIG. 3 is a block diagram illustrating a low frequency driving part shown in FIG. 2.
Figures 4, 5:
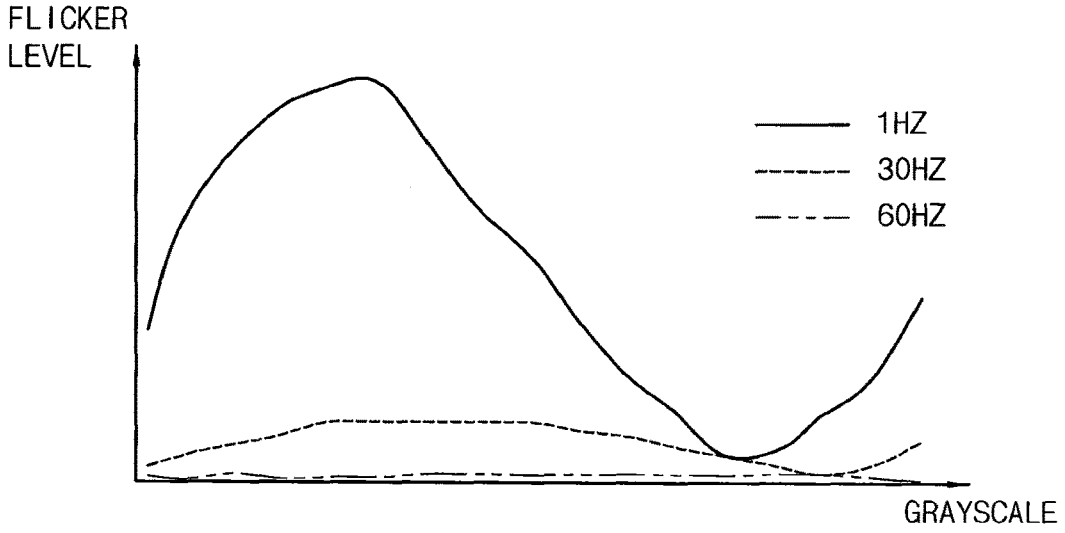
FIG. 4 is a conceptual diagram illustrating segments defined by a segmenting part shown in FIG. 3.
FIG. 5 is a graph illustrating a flicker level according to luminance of pixels which is used in a pixel flicker determining part shown in FIG. 3.
Figure 6:
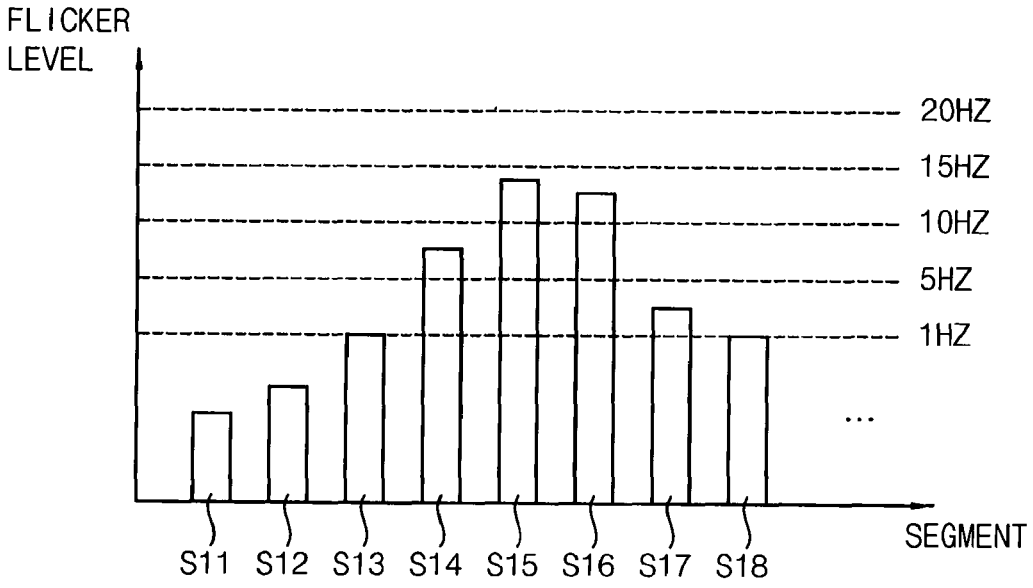
FIG. 6 is a conceptual diagram illustrating an operation of a frame rate determining part shown in FIG. 3.

FIG. 2 is a block diagram illustrating the timing controller 200 shown in FIG. 1. FIG. 3 is a block diagram illustrating the low frequency driving part 240 shown in FIG. 2. FIG. 4 is a conceptual diagram illustrating segments defined by the segmenting part 242 shown in FIG. 3. FIG. 5 is a graph illustrating a flicker level according to luminance of pixels which is used in a pixel flicker determining part 243 shown in FIG. 3. FIG. 6 is a conceptual diagram illustrating an operation of the frame rate determining part 245 shown in FIG. 3.

Referring to FIGS. 1 to 6, the timing controller 200 includes an image converting part (or an image converter) 220, a low frequency driving part (or a low frequency driver) 240 and a signal generating part (or a signal generator) 260.

The image converting part 220 compensates grayscale data of the input image data RGB and rearranges the input image data RGB to generate the data signal DATA to correspond to a data type of the data driver 500. The data signal DATA may be in a digital form (type). The image converting part 220 outputs the data signal DATA to the data driver 500.

For example, the image converting part 220 may include an adaptive color correcting part (or adaptive color corrector) and a dynamic capacitance compensating part (or a dynamic capacitance compensator).

In some embodiments, the adaptive color correcting part receives the grayscale data of the input image data RGB, and operates an adaptive color correction ("ACC"). The adaptive color correcting part may compensate the grayscale data using a gamma curve.

In some embodiments, the dynamic capacitance compensating part operates a dynamic capacitance compensation ("DCC"), which compensates the grayscale data of present frame data using previous frame data and the present frame data.

The low frequency driving part 240 receives the input image data RGB. The low frequency driving part 240 determines a frame rate FR of the display panel 100 based on the input image data RGB. The low frequency driving part 240 may output the frame rate FR to the signal generating part 260.

The signal generating part 260 receives the input control signal CONT. The signal generating part 260 generates the first control signal CONT1 to control a driving timing of the gate driver 300 based on the input control signal CONT and the frame rate FR. The signal generating part 260 generates the second control signal CONT2 to control a driving timing of the data driver 500 based on the input control signal CONT and the frame rate FR. The signal generating part 260 generates the third control signal CONT3 to control a driving timing of the gamma reference voltage generator 400 based on the input control signal CONT and the frame rate FR.

The signal generating part 260 outputs the first control signal CONT1 to the gate driver 300. The signal generating part 260 outputs the second control signal CONT2 to the data driver 500. The signal generating part 260 outputs the third control signal CONT3 to the gamma reference voltage generator 400.

The low frequency driving part 240 includes a static image determining part 241 (or a static image calculator), a segmenting part 242, a pixel flicker determining part (or a pixel flicker calculator) 243, a segment flicker determining part (or a segment flicker calculator) 244 and a frame rate determining part (or a frame rate calculator) 245.

The static image determining part 241 receives the input image data RGB. The static image determining part 241 determines whether the input image data RGB represent a static image or a video image.

The segmenting part 242 divides the input image data RGB into a plurality of segments S11 to S58. Although, the input image data RGB are divided into forty segments in five rows and eight columns, as shown in FIG. 4, the present inventive concept is not limited to this number of the segments and any suitable number of segments may be used.

Each of the segments S11 to S58 may have a rectangular shape including a longer side extending in a horizontal direction. To a human vision, the flicker in a rectangular shape including a longer side extending in a horizontal direction is detected much more than the flicker in a rectangular shape including a longer side extending in a vertical direction. Thus, the shape of the segment S11 to S58 may be the rectangular shape including a longer side extending in a horizontal direction.

The pixel flicker determining part 243 determines a flicker level according to a luminance of a pixel. The flicker level of the pixel may be distributed as shown in FIG. 5 according to a luminance of the pixel and the frame rate FR of the display panel 100.

The pixel flicker determining part 243 may determine the flicker level of the pixel using flicker levels according to luminance of the pixels and the frame rates FR.

For example, the pixel flicker determining part 243 may include a lookup table including flicker levels according to luminance of the pixels and the frame rates FR.

The input image data RGB may include a red grayscale R, a green grayscale G and a blue grayscale B. The input image data RGB may be determined in a RGB color space. The low frequency driving part 240 may extract a luminance of the pixel from the input image data RGB in the RGB color space. For example, the low frequency driving part 240 may include an RGB to Y converter to extract the luminance of the pixel from the input image data RGB in the RGB color space.

The segment flicker determining part 244 generates a flicker level of the segment. The segment flicker determining part 244 generates the flicker level of the segment using the flicker level of the pixel.

For example, the segment flicker determining part 244 may add up (or sum) the flicker levels of the pixels in the segment.

For example, when the segment includes a hundred pixels, the pixel flicker determining part 243 respectively determines a hundred flicker levels of the hundred pixels, and the segment flicker determining part 244 adds up (or sums) the hundred flicker levels of the hundred pixels to generate the flicker level of the segment.

Alternatively, the segment flicker determining part 244 may set weights of the pixels according to positions of the pixels. The segment flicker determining part 244 may calculate (e.g., operate) a weighted sum of the flicker levels of the pixels to generate the flicker level of the segment.

For example, when an outside portion of the display panel 100 is susceptible to flicker, the pixels in the outside portion may have a relatively large weight.

According to other embodiments, the segment flicker determining part 244 may operate various other suitable operations for the flicker level of the pixels to generate the flicker level of the segment.

For example, when the display panel 100 has forty segments, the segment flicker determining part 244 generates forty flicker levels corresponding to the first to forty segments.

In an example embodiment, the segmenting part 242, the pixel flicker determining part 243 and the segment flicker determining part 244 may operate when the input image data RGB represents a static image.

In an example embodiment, positions of the segmenting part 242 and the pixel flicker determining part 243 may be switched with each other.

The frame rate determining part 245 determines the frame rate FR of the display panel 100 based on the flicker level of the segment.

The frame rate determining part 245 may compare the maximum flicker level of the segments to a threshold to determine the frame rate FR.

Referring to FIG. 6, when the maximum flicker level of the segments is the flicker level of a fifth segment S15, the frame rate determining part 245 may compare the flicker level of the fifth segment S15 to thresholds for frame rates. The flicker level of the fifth segment S15 is greater than a threshold for the frame rate of 10 Hz and less than a threshold for the frame rate of 15 Hz so that the frame rate FR of the display panel 100 may be determined to be 15 Hz.

The frame rate determining part 245 may compare an average of flicker levels of segments having relatively high flicker levels to a threshold to determine the frame rate FR of the display panel 100.

For example, when fourth to sixth segments S14, S15 and S16 have three maximum flicker levels, as shown in FIG. 6, the frame rate determining part 245 calculates an average of the flicker levels of the fourth to sixth segments S14, S15 and S16 and compares the average of the flicker levels of the fourth to sixth segments S14, S15 and S16 to thresholds for frame rates. The average of the flicker levels of the fourth to sixth segments S14, S15 and S16 is greater than a threshold for the frame rate of 10 Hz and less than a threshold for the frame rate of 15 Hz so that the frame rate FR of the display panel 100 may be determined to be 15 Hz.

According to other embodiments, the frame rate determining part 245 may operate various other suitable operations for the flicker level of the segments to determine the frame rate FR.

In an example embodiment, when the input image data RGB represents a video image, the frame rate determining part 245 may determine the frame rate FR as a high frequency regardless of the flicker level of the segment. For example, the high frequency may be equal to or greater than about 60 Hz. For example, the high frequency may be one of about 60 Hz, about 120 Hz and/or about 240 Hz. When the input image data RGB represents a static image, the frame rate determining part 245 may determine the frame rate FR as one of low frequencies based on the flicker level of the segment. For example, the low frequency may be less than 60 Hz. For example, the low frequency may be one of about 1 Hz, about 5 Hz, about 10 Hz, about 15 Hz, about 20 Hz and/or about 30 Hz.

Figure 7A:
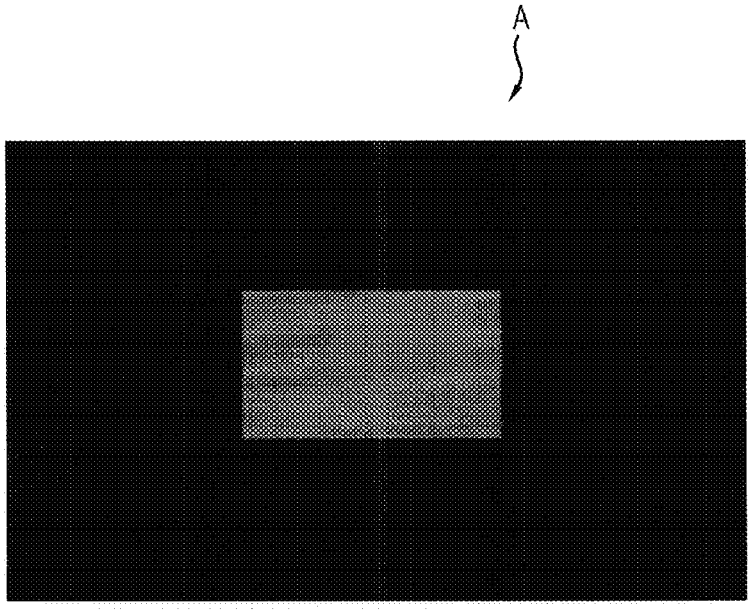
FIGS. 7A and 7B are plan views illustrating samples of input images.
Figure 7B:
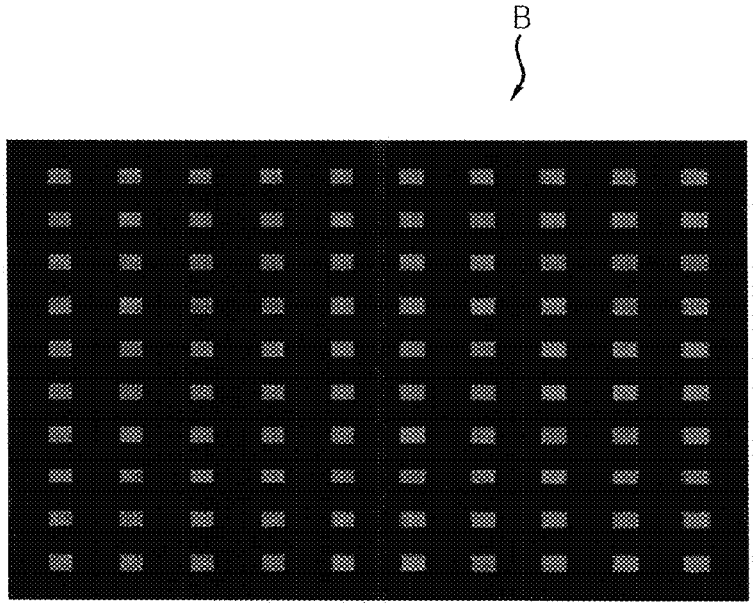
Figure 8A:
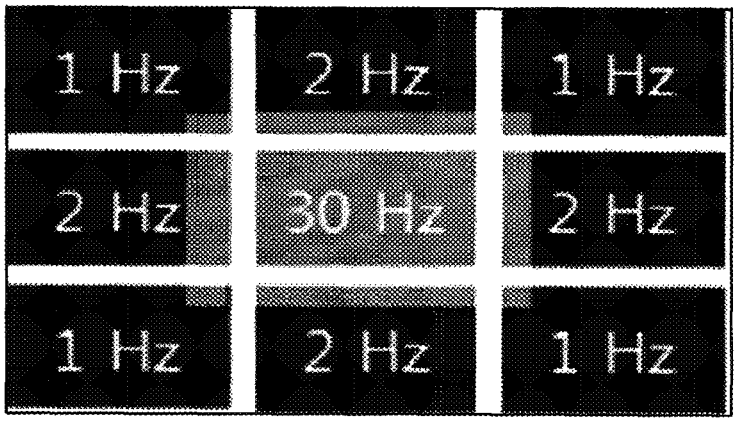
FIGS. 8A and 8B are conceptual diagrams illustrating frame rates determined by the low frequency driving part shown in FIG. 3 for the samples of the input images shown in FIGS. 7A and 7B.
Figure 8B:
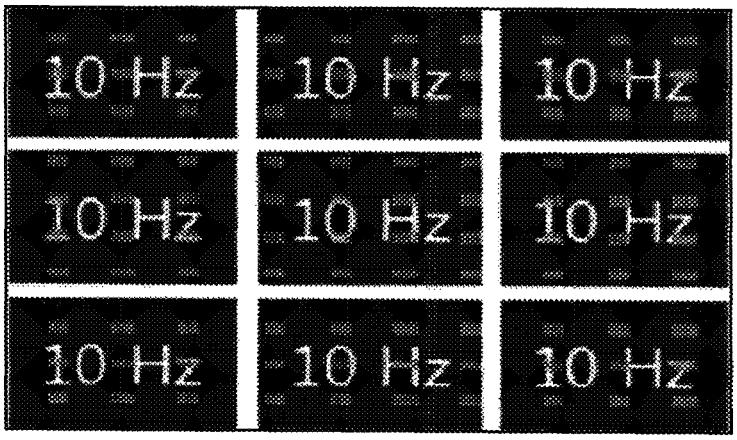

FIGS. 7A and 7B are plan views illustrating samples A and B of input images. FIGS. 8A and 8B are conceptual diagrams illustrating a frame rate FR determined by the low frequency driving part 240 shown in FIG. 3 for the samples A and B of the input images shown in FIGS. 7A and 7B.

In FIGS. 7A and 7B, the input image data A and B respectively represent static images. The input image data A and B shown in FIGS. 7A and 7B commonly include a first grayscale representing black and a second grayscale representing gray. In FIGS. 7A and 7B, a ratio of the first grayscale and the second grayscale of the input image data A is substantially the same as a ratio of the first grayscale and the second grayscale of the input image data B. In the input image data A shown in FIG. 7A, the second grayscale is concentrated at a central portion of the display panel. In the input image data B shown in FIG. 7B, the second grayscale is well distributed throughout an entire portion of the display panel.

For example, the input image data A and B are respectively divided into nine segments as shown in FIGS. 8A and 8B.

Referring to FIGS. 1 to 8B, the static image determining part 241 of the low frequency driving part 240 determines whether the input image data A shown in FIG. 7A represent a static image or a video image.

The segmenting part 242 divides the input image data A into nine segments.

The pixel flicker determining part 243 generates flicker levels of pixels of the input image data A based on luminance of the pixels.

The segment flicker determining part 244 generates flicker levels of nine segments of the input image data A.

The frame rate determining part 245 determines the frame rate FR of the display panel 100 based on the flicker level of the segments.

For example, desired or optimal frame rates, which do not generate the flicker, of first, third, seventh and ninth segments of the input image data A, which are at (e.g., disposed at) corner portions of the display panel 100, may be 1 Hz. Optimal frame rates, which do not generate the flicker, of second, fourth, sixth and eighth segments of the input image data A which are at (e.g., disposed at) side portions of the display panel 100 may be 2 Hz. An optimal frame rate, which does not generate the flicker, of the fifth segment of the input image data A, which is at (e.g., disposed at) a central portion of the display panel 100, may be 30 Hz.

The frame rate determining part 245 determines the frame rate FR of the display panel 100 to be 30 Hz based on the maximum flicker level (i.e., a flicker level of the fifth segment) of the segments.

The static image determining part 241 of the low frequency driving part 240 determines whether the input image data B shown in FIG. 7B represent a static image or a video image.

The segmenting part 242 divides the input image data B into nine segments.

The pixel flicker determining part 243 generates flicker levels of pixels of the input image data B based on luminance of the pixels.

The segment flicker determining part 244 generates flicker levels of nine segments of the input image data B.

The frame rate determining part 245 determines the frame rate FR of the display panel 100 based on the flicker level of the segments.

For example, optimal frame rates, which do not generate the flicker, of all the segments of the input image data B may be the same as one another. The optimal frame rates of all the segments of the input image data B may be 10 Hz.

The frame rate determining part 245 determines the frame rate FR of the display panel 100 to 10 Hz based on the flicker level of the segments.

When the input image data A shown in FIG. 7A and the input image data B shown in FIG. 7B are driven at the same frame rate, the input image data A shown in FIG. 7A may generate the flicker much more than the input image data B shown in FIG. 7B.

According to a comparable histogram analyzing method which accumulates grayscale levels of input image data to determine a frame rate of the display panel, the input image data A shown in FIG. 7A and the input image data B shown in FIG. 7B are driven at the same frame rate. Thus, when the display panel 100 displays the input image data B shown in FIG. 7B, the flicker may not be generated. However, when the display panel 100 displays the input image data A shown in FIG. 7A, the flicker may be generated.

According to the present example embodiment, the frame rate FR of the display panel 100 is adjusted according to the input image data RGB so that power consumption of the display apparatus may be reduced. In addition, the frame rate FR is determined using the flicker level of the segments of the input image data so that display quality of the display panel 100 may be increased (e.g., improved).

According to the present example embodiment, power consumption of the display apparatus may be reduced and display quality of the display panel may be increased (e.g., improved).

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and aspects of the present inventive concept. Accordingly, all such modifications are intended to be included within the scope of the present inventive concept as defined in the claims, and equivalents thereof. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel configured to display an image;

a low frequency driving part configured to divide an input image into a plurality of segments, to generate flicker levels of respective ones of the segments, and to determine a frame rate of the display panel based on the flicker levels of the segments; and a data driver configured to output a data voltage to the display panel at the frame rate, wherein a first input image comprises a first grayscale representing a first luminance and a second grayscale representing a second luminance greater than the first luminance, the first input image having a first ratio between the first grayscale and the second grayscale, the second grayscale being concentrated at a central portion of the display panel in the first input image, a second input image comprises the first grayscale and the second grayscale, the second input image having the first ratio between the first grayscale and the second grayscale, the second grayscale being distributed throughout the display panel in the second input image, and a first frame rate for the first input image is different from a second frame rate for the second input image.

2. The display apparatus of claim 1, wherein the low frequency driving part comprises a static image determining part configured to determine whether the input image is a static image or a video image, and when the input image is the static image, the low frequency driving part determines the frame rate of the display panel based on the flicker levels of the segments.

3. The display apparatus of claim 1, wherein the low frequency driving part is configured to convert luminance of a plurality of pixels at each of the segments into flicker levels of respective ones of the pixels, and to calculate the flicker levels of the pixels in the segments to generate the flicker levels of the segments.

4. The display apparatus of claim 3, wherein the input image comprises a red grayscale, a green grayscale and a blue grayscale, and the low frequency driving part is configured to extract the luminance of the plurality of pixels at each of the segments based on the red grayscale, the green grayscale and the blue grayscale.

5. The display apparatus of claim 3, wherein the low frequency driving part is configured to add up the flicker levels of the respective ones of the pixels to generate the flicker levels of the segments.

6. The display apparatus of claim 3, wherein the low frequency driving part is configured to set weights of the respective ones of the pixels according to positions of the respective ones of the pixels, and to calculate a weighted sum of flicker levels of the pixels to generate the flicker levels of the segments.

7. The display apparatus of claim 1, wherein the first frame rate is greater than the second frame rate.

* * * * *